US006371043B1

(12) United States Patent
Pearison

(10) Patent No.: US 6,371,043 B1
(45) Date of Patent: Apr. 16, 2002

(54) FLAG CHAIN APPARATUS

(75) Inventor: John Charles Pearison, Evansville, IN (US)

(73) Assignee: Pearison, Inc., Cynthiana, IN (US)

( * ) Notice: Subject to any disclaimer, the term of this patent is extended or adjusted under 35 U.S.C. 154(b) by 0 days.

(21) Appl. No.: 09/257,731

(22) Filed: Feb. 25, 1999

(51) Int. Cl.[7] ..... G09F 17/00
(52) U.S. Cl. ..... 116/173; 446/236
(58) Field of Search ..... 116/173, 174, 116/175; D11/166; 40/218, 215, 603, 604, 617; 446/236, 240, 266; 482/81, 93, 110, 129

(56) References Cited

U.S. PATENT DOCUMENTS

| | | | | | |
|---|---|---|---|---|---|
| 1,195,171 | A | * | 8/1916 | Bacon et al. | 242/141 |
| 1,595,395 | A | * | 8/1926 | Herbener | 116/173 |
| 1,680,703 | A | * | 8/1928 | Sullivan | 116/173 |
| 1,818,301 | A | * | 8/1931 | Canaday | 119/805 |
| 1,854,012 | A | | 4/1932 | Ames | |
| 2,284,209 | A | * | 5/1942 | Holm | 40/218 |
| 2,437,444 | A | | 3/1948 | Srofe | |
| 2,655,749 | A | * | 10/1953 | La Fontaine | 40/604 |
| 2,688,303 | A | | 9/1954 | Leander | |
| 2,902,786 | A | * | 9/1959 | Schneider | 40/623 |
| 2,911,658 | A | * | 11/1959 | Stanley et al. | 441/3 |
| 2,911,746 | A | | 11/1959 | Frey | |
| 3,011,810 | A | * | 12/1961 | Crowder | 403/328 |
| 3,089,268 | A | | 5/1963 | Frey et al. | |
| 3,158,132 | A | | 11/1964 | Guthrie | |
| 3,354,770 | A | * | 11/1967 | Haug | 84/477 B |
| 3,425,070 | A | * | 2/1969 | Clark | 441/10 |
| 3,439,446 | A | * | 4/1969 | Alonzo | 446/266 |
| 3,550,312 | A | * | 12/1970 | East | 446/247 |
| 3,678,886 | A | * | 7/1972 | Tibbet | 116/173 |
| 4,474,132 | A | | 10/1984 | Fritsch | |
| 4,813,369 | A | | 3/1989 | Moreland | 116/173 |
| 4,913,940 | A | * | 4/1990 | Pratt | 428/7 |
| 5,246,517 | A | | 9/1993 | Watson | |
| 5,253,608 | A | | 10/1993 | Burke | |
| 5,329,873 | A | | 7/1994 | Tiballi | 116/173 |
| 5,452,679 | A | * | 9/1995 | Eckley | 116/200 |
| 5,533,464 | A | | 7/1996 | Todd | |
| 5,732,494 | A | * | 3/1998 | Davey | 40/604 |
| 5,904,116 | A | * | 5/1999 | Wyner et al. | 116/173 |
| 5,988,101 | A | * | 11/1999 | Jacobs et al. | 116/205 |

FOREIGN PATENT DOCUMENTS

| | | | | |
|---|---|---|---|---|
| DE | 611723 | * | 4/1935 | 116/173 |
| WO | WO-90/12385 A1 | * | 10/1990 | G09F/17/00 |

* cited by examiner

*Primary Examiner*—Diego Gutierrez
*Assistant Examiner*—R. Alexander Smith
(74) *Attorney, Agent, or Firm*—Woodard, Emhardt, Naughton, Moriarty & McNett

(57) ABSTRACT

An apparatus for supporting a flag on a chain. The apparatus includes a pair of cylindrical members coupled by hook and loop fasteners to an edge of a flag. A flexible chain interconnects both members and terminates at one end with a ring. A user may grab the ring and swing the flag so as to display it.

31 Claims, 2 Drawing Sheets

FLAG CHAIN APPARATUS

BACKGROUND OF THE INVENTION

The present invention relates to an apparatus for supporting a flag on a chain. More specifically, the invention relates to an apparatus that may be coupled to a flag so as to permit a user to swing the flag.

Flags are displayed in front of audiences in a variety of ways. Two ways include displaying the flags on poles carried by people, and displaying the flags on chains carried or swung by people. The two flags are often of different configurations. Pole flags may include eyelets or a sleeve for connection to the pole, whereas chain flags conclude a chain sewn into a sleeve or header of the flag. Because of the time and expense involved in sewing the chain into a flag, chain flags are typically not compatible with pole applications, and vise versa. This incompatibility results in the owner of the flags having to maintain multiple versions of the same flag based on how it is to be displayed.

What is needed is a method for displaying the flag that overcomes these disadvantages. The present invention does this in a novel and unobvious way.

SUMMARY OF THE INVENTION

In one aspect of the present invention, there is an apparatus for holding a flag having a sleeve therein, comprising a first member attachable to the flag within the sleeve at a first location, and a second member attachable to the flag within the sleeve at a second location. Also, there is a flexible line connected to the first member and to the second member. The apparatus also includes a handle for holding the apparatus by hand.

These and other aspects of the present invention will be apparent from the description of the preferred embodiment, the drawings, and the claims to follow.

DESCRIPTION OF THE PREFERRED EMBODIMENTS

Figure 1:
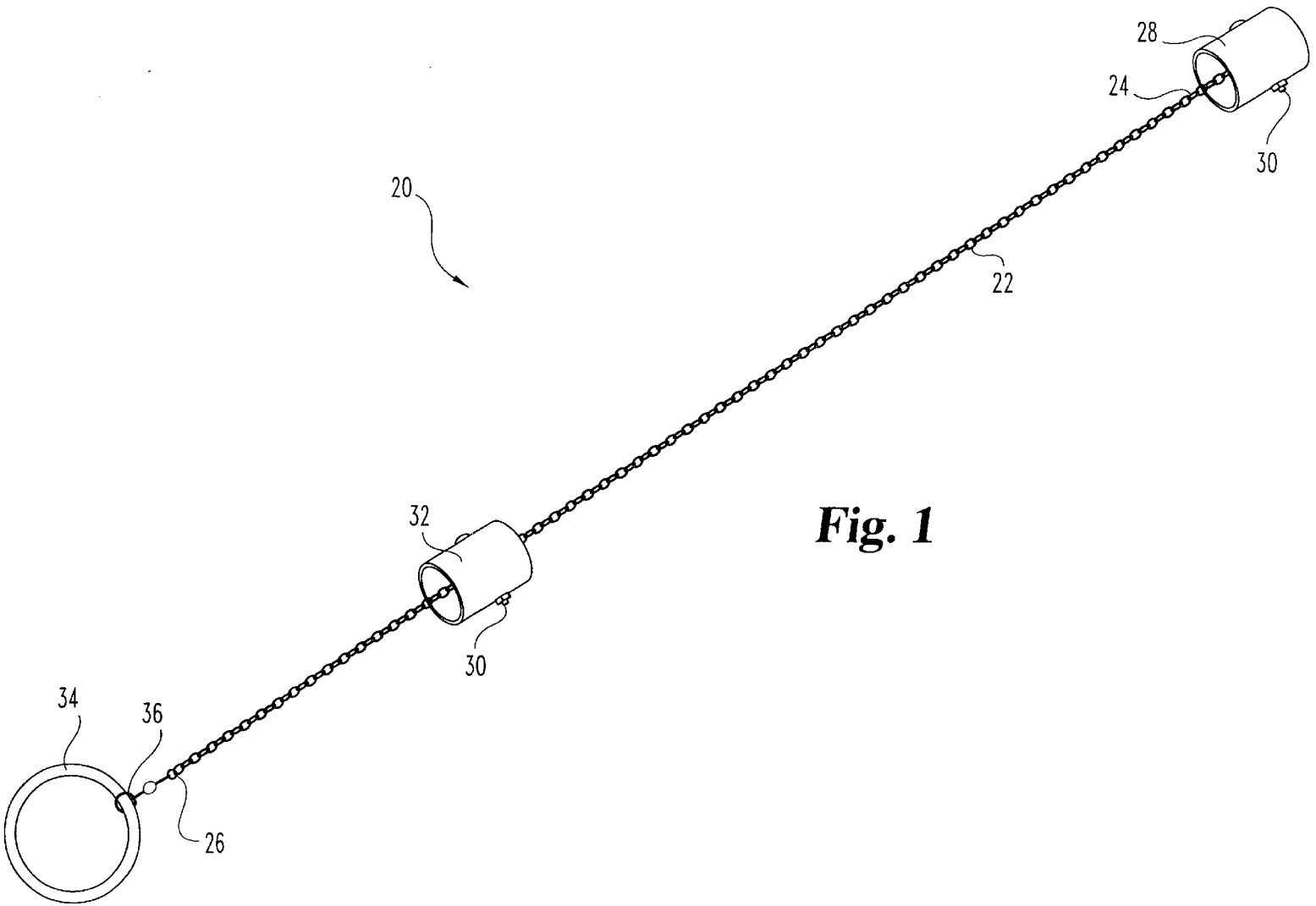
FIG. 1 is a perspective view of an apparatus for supporting a flag according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

The present invention relates to an apparatus for displaying an article such as a flag, pennant, sign, or similar article. The present invention permits the user to swing the article through the air, thereby displaying it to others. As an example, the present invention permits users such as cheerleaders, majorettes, or marching band members to display flags before an audience.

In one embodiment, the present invention includes a pair of cylindrical members positioned along a flexible chain.

The members are attached near each end of an edge of the flag. Each member is attached to the flag by hook and loop fasteners. One end of the chain includes a handle to be held by the user. The user can hold the handle and swing the chain, members, and flag through the air. Centrifugal force of the flag and members keeps the chain generally extended as the user holds the handle and swings the flag through the air. In one embodiment, the present invention permits a flag such as a pole flag to be releasably attached to the members. In this way, the owner of the flag can have it displayed as either a pole flag or a chain flag, without the need to buy additional flags to be used as chain flags.

FIG. 1 shows a flag chain apparatus 20 according to one embodiment of the present invention. Apparatus 20 includes a flexible line 22 with a first end 24 and a second end 26. In a most preferred embodiment, flexible line 22 is a steel, #12 electrical chain. However, the present invention contemplates means for flexibly connecting two members that includes any flexible line, chain, rope, wire, cord, or their equivalents, fabricated from metal, plastic, cloth or equivalent materials, that are suitably flexible so as to be extended as the flag is swung through the air.

A first member 28 is attached by a fastener 30 near first end 24 of chain 22. A second member is attached along chain 22 at a point intermediate first end 24 and second end 26. First member 22 is flexibly connected to second member 32 by flexible line 22. Flexible line 22 preferably extends through member 32. However, the present invention also contemplates a flag chain apparatus including two lengths of flexible line, in which one length of flexible line connects first member 28 and second member 32, and a second length of flexible line is attached to second member 32.

In a most preferred embodiment, a fastener 30 such as a bolt and nut connects chain 22 to members 28 and 32, the bolt extending through one wall of the member, through a link of chain 22, and through the other wall of the member. Fastener 30 preferably includes a fastener-locking mechanism, such as a nut with a locking nylon insert. The present invention also contemplates the many other types of fasteners suitable for fastening a flexible line to a member, such as interlocking pins, welded rods, their equivalents, and other means known to those of ordinary skill in the art. In addition, the connection of first member 28 to fastener 30 may be a permanent connection, such as by welding, brazing, adhering or other permanent means.

In a preferred embodiment, the connection of second member 32 to flexible line 22 includes use of a releasable fastener 30, such that the fastener may be released and member 32 repositioned along flexible line 22 to accommodate flags of different sizes. By releasing fastener 30, member 32 becomes slidable along flexible line 22. In a preferred embodiment, flexible line 22 is long enough to accommodate a preferred spacing of about 30 inches between the outer ends of the members, this spacing compatible with a flag sleeve length of 30 inches..

Although members 28 and 32 have been depicted as thin walled open cylinders, the present invention also contemplates members of other configurations, including members with thick walls, or round, rectangular, or polygonal cross sections. Further, member 28 need not be open, but may also be of a generally solid configuration. In another embodiment of the present invention which contemplates the use of two lengths of flexible line, second member 32 may also be solid, with a first length of line flexibly connecting member 28 and one side of a solid member. A second length of chain is attached to another side of the solid member. In addition, other embodiments of the present invention also contemplate the use of generally flat plates as members. The members are preferably fabricated from metal, plastic, or wood.

A handle 34 is attached near second end 26 of chain 22. In a most preferred embodiment, handle 34 is coupled to end 26 by a slippable coupling 36. Handle 34 permits a user to comfortably and safely hold apparatus 20 while swinging it. Although a handle shaped as a ring has been shown, there are other means for holding chain 22, including a grip, a grasp, a crank, a knob, a grip, and arm, a hoop, and their equivalents known to those of ordinary skill in the art. Slippable coupling 36 helps prevent chain 22 from becoming entangled, twisted, or knotted as it is swung through the air. Other types of slippable couplings are contemplated by the present invention, including for example, couplings that are affixed to a specific location on handle 34, but permit rotation of flexible line 22 about the coupling. The present invention also contemplates those embodiments in which flexible line 22 is affixed to a handle without a slippable coupling.

Figure 2:
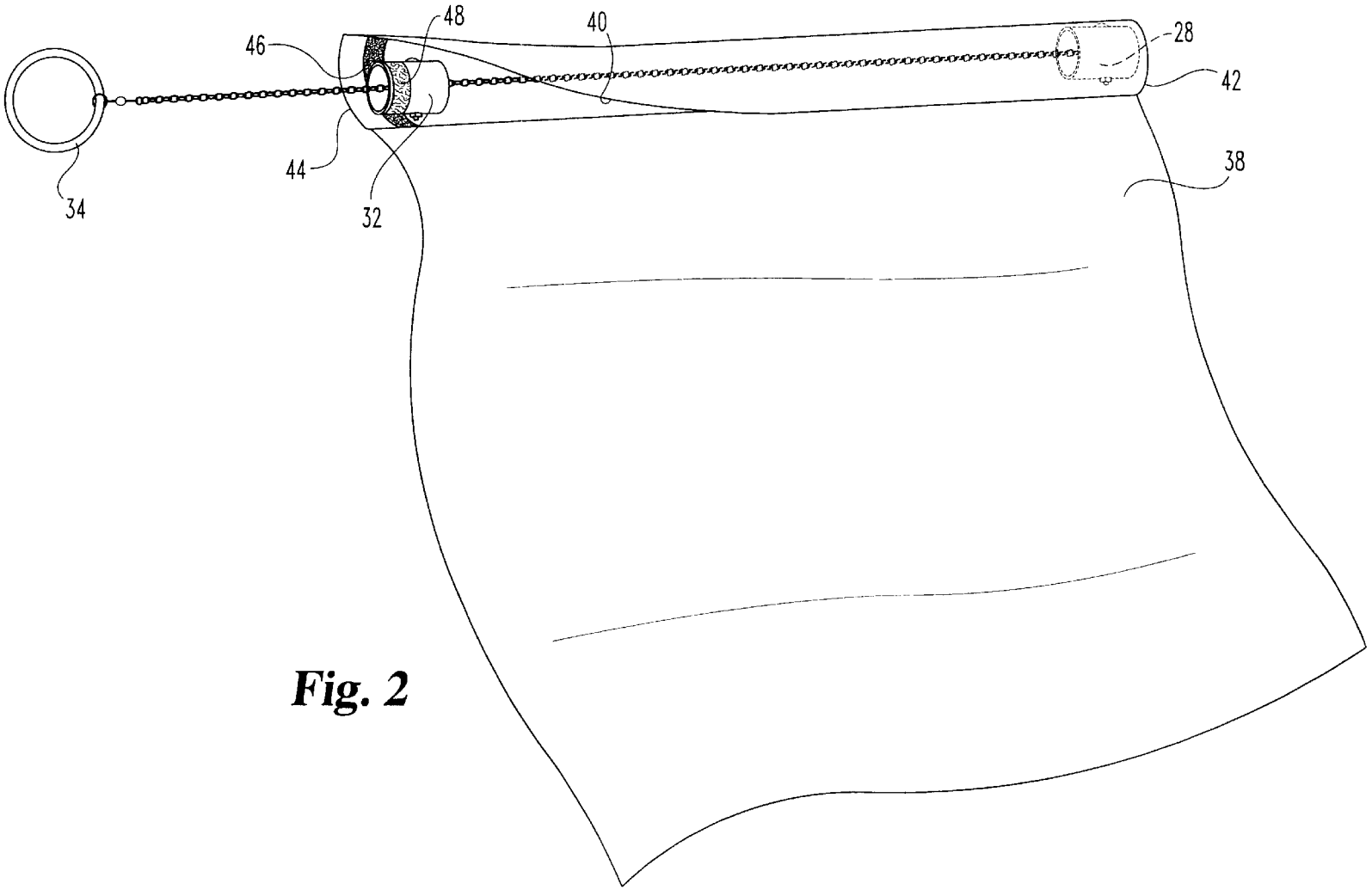
FIG. 2 is a perspective view of the apparatus of FIG. 1 attached to a flag.

Apparatus 20 is shown connected to a flag or pennant 38 in FIG. 2. Flag 38 includes an edge 40, edge 40 having a first end 42 and a second end 44. In one embodiment of the present invention, a strip of loop-type fasteners 46 is attached near second end 44 of edge 40. A mating strip of hook-type fasteners 48 is attached to second member 32. Similar hook and loop fasteners (not shown) are used for first members 28 and first end 42 of flag 38, respectively. In this embodiment, edge 40 is then wrapped around members 28 and 32 so as to form a sleeve of the flag. Fasteners 46 and 48 releasably couple members 28 and 32 to flag 38. Through the members, flexible line 22 is coupled to the flag.

Although hook and loop type fasteners have been shown and described for attaching apparatus 20 to a flag, the present invention also contemplates other means for releasably coupling the members to the flag, including by way of example clamps, either separate or incorporated into the members, and pinned attachments that cooperate with a hole or eyelet (not shown) incorporated into the flag, and their equivalents. Although an embodiment of the present invention has been shown and described as being attached to a flag edge that is rolled into a sleeve, the present invention also contemplates attachment to flags that incorporate sewn sleeves, eyelets, or other pole-attachment features along a flag edge.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus comprising:

a flag having a sleeve therein;

a first member non-rotatably attached to the said flag within the sleeve at a first location;

a separate second member non-rotatably attached to the flag within the sleeve at a second location;

a flexible line non-rotatably attached to said first member and to said second member and extending through said sleeve of the flag.

2. The apparatus of claim 1 wherein said flexible line is slippable about a handle.

3. The apparatus of claim 2 wherein said flexible line is a chain.

4. The apparatus of claim 3 wherein said first member and said second member are attachable to said flag by hook and loop fasteners.

5. The apparatus of claim 4 wherein said first member is generally cylindrical and said second member is generally cylindrical.

6. The apparatus of claim 5 wherein said handle is a ring.

7. The apparatus of claim 6 wherein said second member is capable of being repositioned along said flexible line.

8. The apparatus of claim 7 wherein the distance from said first member to said second member is about 30 inches.

9. The apparatus of claim 1 wherein said flexible line is a chain.

10. The apparatus of claim 1 wherein said first member and said second member are attachable to said flag by hook and loop fasteners.

11. The apparatus of claim 1 wherein said first member is generally cylindrical and said second member is generally cylindrical.

12. The apparatus of claim 1 which further comprises a handle connected to an assembly formed by said first member, said second member and said flexible line wherein said handle is a ring.

13. The apparatus of claim 1 wherein said second member is capable of being repositioned along said flexible line.

14. The apparatus of claim 1 wherein the distance from said first member to said second member is about 30 inches.

15. The apparatus of claim 1 wherein said first member has a first cylindrical outer surface with at least a portion of the sleeve being wrapped around the first outer surface, and said second member has a second cylindrical outer surface with a least a portion of the sleeve being wrapped around the second outer surface.

16. The apparatus of claim 1 wherein the sleeve is along an edge of the flag, said first member is generally cylindrical about a first axis, said member is generally cylindrical about a second axis, and the first axis and the second axis are parallel with the edge when said first member and said second member are attached within the sleeve.

17. An apparatus for holding a flag comprising:

a flag having a sleeve;

a first member non-rotatably attached to the sleeve of said flag, comprising:

a second member non-rotatably attached to the sleeve of said flag; and means for flexibly attaching said first member to said second member, said second member capable of being repositioned along said flexibly attaching means, said first member and said second member being non-rotatably attached to said flexible attaching means and located within the sleeve;

wherein said first member and said second member are releasably coupled to said flag.

18. The apparatus of claim 17 wherein said flexible attaching means is a chain.

19. The apparatus of claim 18 wherein said first member and said second member are attachable to said flag by hook and loop fasteners.

20. The apparatus of claim 19 wherein said first member is generally cylindrical and said second member is generally cylindrical.

21. The apparatus of claim 20 which further comprises a handle attached to said flexible attaching means.

22. The apparatus of claim 21 wherein said flexible attaching means is slippable about said handle.

23. The apparatus of claim 22 wherein said second member is capable of being repositioning along said flexible attaching means.

24. The apparatus of claim 18 which further comprises a repeatedly releasable fastener for attaching said second member to said chain.

25. The apparatus of claim 17 wherein said first member and said second member are attachable to said flag by hook and loop fasteners.

26. The apparatus of claim 17 wherein said first member is generally cylindrical and said second member is generally cylindrical.

27. The apparatus of claim 17 which further comprises a handle attached to said flexible attaching means.

28. The apparatus of claim 17 which further comprises a handle, wherein said flexible attaching means is slippable about said handle.

29. The apparatus of claim 17 wherein the distance from said first member to said second member is about 30 inches.

30. The apparatus of claim 17 wherein the sleeve is along an edge of the flag, said first member has a first cylindrical outer surface with at least a portion of the sleeve being wrapped around the first outer surface, and said second member has a second cylindrical outer surface with at least a portion of the sleeve being wrapped around the second outer surface.

31. The apparatus of claim 17 wherein the sleeve is along an edge of the flag, said first member is generally cylindrical about a first axis, said second member is generally cylindrical about a second axis, and the first axis and the second axis are parallel with the edge when said first member and said second member are attached within the sleeve.

* * * * *